US006076860A

United States Patent [19]

Holman et al.

[11] Patent Number: 6,076,860

[45] Date of Patent: Jun. 20, 2000

[54] SCRATCH-OFF LOTTERY GAME WITH DUAL TRANSPARENT LAYERS

[75] Inventors: Stephen John Holman, Queensland, Australia; Francois Gougeon, Quebec, Canada

[73] Assignee: Oberthur Gaming Technologies Inc, Montreal, Canada

[21] Appl. No.: 09/208,228

[22] Filed: Dec. 9, 1998

[51] Int. Cl.[7] ..... B42D 15/00

[52] U.S. Cl. ..... 283/109; 283/110; 283/111; 283/903

[58] Field of Search ..... 273/139, 138.1, 273/269; 283/903, 901, 110, 111, 109

[56] References Cited

U.S. PATENT DOCUMENTS

Re. 34,673 7/1994 Desbiens .

5,074,566 12/1991 Desbiens ..... 273/269

5,193,815 3/1993 Pollard ..... 273/269

5,544,881 8/1996 Rua, Jr. et al. ..... 273/139

5,560,608 10/1996 Silverschotz ..... 273/240

5,704,647 1/1998 Desbiens .

*Primary Examiner*—Willmon Fridie, Jr.

*Attorney, Agent, or Firm*—Watov & Kipnes, P.C.

[57] ABSTRACT

A scratch-off lottery game including a substrate having at least one area having printed indicia thereon, the printed indicia being covered by at least one clear, transparent layer which can be removed by scratching, and at least one layer on said clear transparent layer which is colored, transparent and made of a non-scratch-off material, the colored transparent layer being affixed to the clear transparent layer in a manner in which removing the clear transparent layer by scratching results in removal of the colored transparent layer.

3 Claims, 1 Drawing Sheet

SCRATCH-OFF LOTTERY GAME WITH DUAL TRANSPARENT LAYERS

FIELD OF THE INVENTION

The present invention relates to a scratchoff lottery ticket and particularly to a ticket having at least a portion thereof having printed indicia covered by a dual transparent layer scratch-off system enabling viewing of the printed indicia therethrough.

BACKGROUND OF THE INVENTION

Scratch-off games comprising a substrate on which a scratchable rub-off coating is applied in order to hide instant prices in the form of a price amount, or a game symbol which is printed directly onto the substrate, are well known and commonly used by lotteries and advertising companies for promotional purposes. With such scratch-off games, the play essentially consists of scratching the rub-off coating or a part thereof in order to hopefully find that one of the instant prices has been printed on the substrate. If an instant price is found, the possessor of the scratch-off ticket wins that amount.

A game called Bingo is also well known. This game makes use of cards on which two dimensional grids form individual boxes. Each box has a randomly selected number printed therein. Bingo random numbers are drawn by some authority. A player marks the corresponding numbers on their card, trying to get a complete horizontal, vertical or diagonal row of the numbers marked. When a player accomplishes this objective, they win a price amount that is usually predetermined before the drawing of numbers starts.

Another scratch-off game comprises a substrate having a first grid of boxes printed thereon, containing winning or losing symbols which are randomly distributed. The first grid is hidden by a scratchable rub-off coating upon which another, second grid is printed and superimposed over the first grid. The second grid contains numbers sequentially printed in its boxes to allow identification of the boxes. In use, a plurality of numbers are drawn at random by some authority. Then, each player scratches the rub-off coating of the boxes bearing the numbers that are drawn in order to uncover the symbols printed within the corresponding boxes of the first grid. If a given number of winning symbols are uncovered, the player will win a specific price amount.

The second grid of numbers printed on the rub-off coating of all of these games is always the same, and only the first grid of randomly selected winning and losing symbols vary from one card to the other. In addition, there is only a single way of playing this scratch game.

A game of this type is disclosed in the Desbiens Reissue Patent No. 34,673, incorporated herein by reference. A two level scratch-off game is disclosed in which a second grid contains the same randomly selected numbers as the first grid. The second grid of numbers is printed on an opaque scratch-off coating covering the first grid. One aspect of the game is conducted as a standard Bingo type game in which selected numbers are scratched off by removing the second grid to reveal the same numbers in the underlying first grid. If the selected numbers form a row (horizontal, vertical or diagonal) a prize may be won. The second level of the game results from the presence of winning game symbols (e.g. price amounts) in the exposed first grid. If the appropriate number or type of symbols are exposed a prize may be won.

The removing of the second grid to reveal the same numbers in the first grid enables the playing to visually observe all of the numbers that have been selected.

In Pollard, U.S. Pat. No. 5,193,815 the opaque layer of the second grid is replaced with a scratch-off, translucent, colored layer. According to this patent, the play area or "user's card" of the bingo game has numbers printed on a substrate. The play area has a printed matrix which is covered by a single layer of material which is translucent, removeable by scratching and colored.

The single layer of material is translucent which allows viewing of the printed symbols and the colored layer therethrough. The coating is colored such that those portions of the colored layer whenviewed after removal of the coating are visually distinct from those portions of the colored layer when viewed through the coating.

Each of the above-mentioned patents provides a system by which the removal of the scratch-off layer in certain play areas or boxes provides a visual distinction with these areas in which the scratch-off layer has not been removed. However, each of the prior art systems places limits on the overall appearance of the scratch-off area and/or is relatively expensive to implement.

It would therefore be a significant advance in the art of producing scratch-off tickets, especially for a Bingo game type of format if a system of differentiating numbers in play from numbers which are not in play can be implemented in a cost efficient and effective manner.

It would be a further advance in the art of producing such scratch-off tickets if a system of differentiating numbers in play from those not in play could be developed which will enable elaborate graphic designs to be printed on the ticket such as those described in U.S. Pat. No. 5,704,647.

SUMMARY OF THE INVENTION

In accordance with the present invention, there is provided a dual transparent layer system which employs at least one clear, transparent scratch-off layer covering a matrix of numbers and at least one colored, transparent layer thereover which is made from a non-scratch-off material. The non-scratch-off layer is joined to the scratch-off layer (e.g. by imprinting directly thereon) such that removal of the transparent scratch-off layer also removes the transparent non-scratch-off layer.

The present invention can be applied to any game in which it is desirable to have a visual display of play indicia (e.g. numbers) through a layer which can be removed by scratching. Such games include, for example, BINGO, crossword puzzle type games and the like.

The employment of the dual transparent layer system of the present invention enables the use of a plurality of transparent inks which can be used to print a wide variety of designs including the multicolor printing techniques disclosed in U.S. Pat. No. 5,704,647 incorporated herein by reference.

The present invention is generally directed to scratch-off lottery tickets in which printed indicia are observable through scratch-off layers. In particular the present invention comprises:

a scratch-off lottery game comprising a substrate having at least one area having printed indicia thereon, the printed indicia being covered by at least one clear, transparent layer which can be removed by scratching, and at least one layer on said clear transparent layer which is colored, transparent and made of a non-scratch-off material, said colored transparent layer being affixed to the clear transparent layer in a manner such that removing the clear transparent layer by scratching results in the removal of the colored transparent layer at the same time.

BRIEF DESCRIPTION OF THE DRAWING

The following drawing is illustrative of an embodiment of the present invention and is not intended to limit the invention as encompassed by the broader description provided herein.

DETAILED DESCRIPTION OF THE INVENTION

Figure 1:
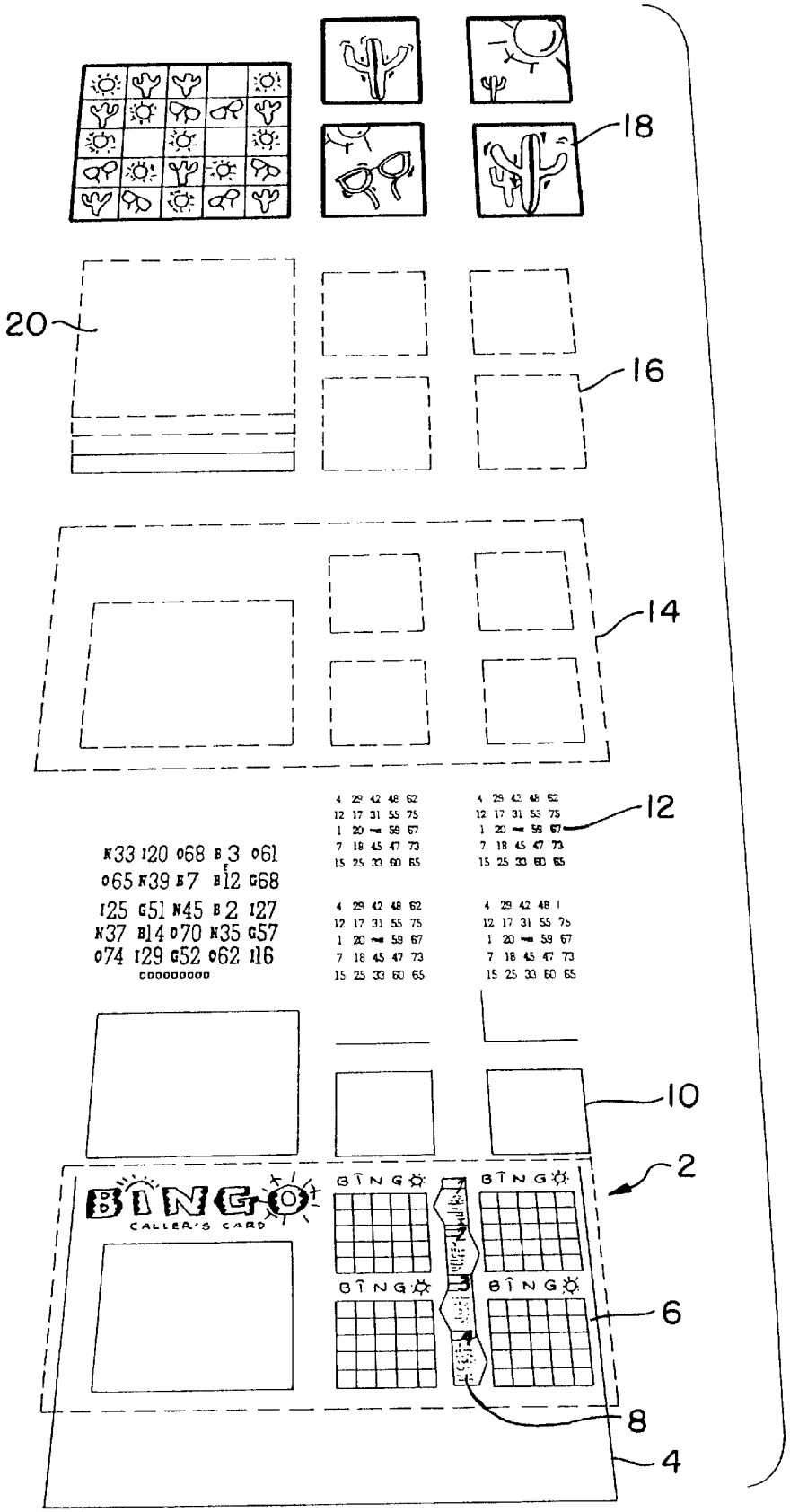
FIG. 1 is a schematic view of an embodiment of a Bingo type lottery ticket employing the dual transparent layer system of the present invention.

Referring to FIG. 1 there is shown a bingo type lottery ticket in which a designated area as hereinafter described employs a dual transparent layer scratch-off system in accordance with the present invention. As used herein the term "dual transparent layer scratch-off system" shall mean the employment of at least one clear (i.e. non-colored) transparent layer having thereon at least one colored transparent layer.

A bingo ticket 2 includes a substrate 4 made of material such as paper, foil, coated board or other and customarily used materials. On ail or a portion of the substrate 4 (a designated area 6 is shown) there is printed various graphics 8. An optional layer 10 may be placed on the designated area 6 to provide a desirable printing background. The layer 10 can, for example, be a lily pad layer when the substrate is a foil, since foils do not provide a desirable printing surface. If the substrate provides a desirable printing surface (e.g. when the substrate is made of paper) then the layer 10 may be omitted.

Printed indicia 12 in the form of prize symbols, numbers and the like is then printed over the layer 10 or directly on the substrate if the layer 10 is omitted, followed by a clear release coating 14 customarily employed on lottery tickets.

In accordance with the present invention there is then provided at least one clear, transparent layer 16 made of a scratch-off material. Placed over the layer 16 is a transparent colored layer 18 made of an overprint ink.

The clear transparent layer 16 employed in the present invention is typically a rubber based layer such as block copolymers made from polystyrene and a suitable copolymer such as poly (ethylene-butylene) or polybutadiene. Such block copolymers can be obtained from the Shell Chemical Company under the Kraton® brand name. Blends of such block copolymers may be employed to vary the cohesive strength, viscosity and adhesion of the transparent layer. A water based layer can also be used based on a fully saturated elastomeric terpolymer such as HYSTRECH® from BF Goodrich Company. The transparent layer may typically contain one or more of the following materials selected from fillers, dispersing agents, and defoamers known to those of ordinary skill in this art.

The transparent colored layer 18 has two purposes. The first is to provide color over the printed indicia, preferably a different color than the background color around the printed indicia. Second, the transparent colored layer, which itself is a non-scratch-off layer must be sufficiently affixed to the clear transparent layer 16 that it is removed when the layer 16 is scratched and removed from the ticket. The preferred transparent colored layer 18 is a flexographic ink layer, preferably a nitrocellulose based ink, a polyamide based ink, or an acrylic based ink. Such inks can be obtained from Flint, Inc. and adhere to the clear transparent layer to a sufficient extent that removal of the layer 16 by scratching also results in the removal of the layer 18. The ink layer 18 is also available as a waterbased ink.

While flexographic printing is a preferred method of applying the layers 16 and 18, it will be understood that other printing methods known to those skilled in the art could be used including silkscreen and rotogravure printing.

The dual transparent system provided by the combination of the layers 16 and 18 enables the holder of the ticket to view the printed indicia thereth rough. When the layers 16 and 18 are removed by scratching, the printed indicia are seen, preferably with a different color background than provided by the layer 18. As a result the holder of the ticket can keep a visual record of the printed indicia which has been exposed.

The arrangement of layers 16 and 18 and particularly the employment of a separate colored, transparent layer made of overprint ink enables exceptional designs to be printed onto the lottery ticket including the printing techniques shown and described in U.S. Pat. No. 5,704,647.

The dual transparent system may be used in conjunction with a conventional system for hiding numbers such as at least one opaque layer 20 as shown in FIG. 1 which in a Bingo type game is used in association with the Caller's Card.

We claim:

1. A scratch-off lottery game comprising a substrate having at least one area having printed indicia thereon, the printed indicia being covered by at least one clear, transparent layer which is removable by scratching, and at least one layer on said clear transparent layer which is colored, transparent and made of a non-scratch-off material, said colored transparent layer being affixed to the clear transparent layer in a manner in which removing the clear transparent layer by scratching results in removal of the colored transparent layer.

2. The scratch-off lottery game of claim 1 wherein the printed indicia are in a first color and the color of the colored transparent layer is of a second color different than the first color.

3. The scratch-off lottery game of claim 1 comprising two areas having printed indicia therein, at least one of areas having printed indicia covered by at least one clear, transparent layer which is removable by scratching and at least one layer on said clear transparent layer which is colored, transparent and made of a non-scratch-off material.

* * * * *